US009887075B2

(12) United States Patent
Hoyes

(10) Patent No.: US 9,887,075 B2
(45) Date of Patent: Feb. 6, 2018

(54) METHOD OF GENERATING ELECTRIC FIELD FOR MANIPULATING CHARGED PARTICLES

(71) Applicant: Micromass UK Limited, Wilmslow (GB)

(72) Inventor: John Brian Hoyes, Stockport (GB)

(73) Assignee: MICROMASS UK LIMITED, Wilmslow (GB)

( * ) Notice: Subject to any disclaimer, the term of this patent is extended or adjusted under 35 U.S.C. 154(b) by 90 days.

(21) Appl. No.: 14/895,520

(22) PCT Filed: May 28, 2014

(86) PCT No.: PCT/GB2014/051613

§ 371 (c)(1),
(2) Date: Dec. 3, 2015

(87) PCT Pub. No.: WO2014/195677

PCT Pub. Date: Dec. 11, 2014

(65) Prior Publication Data

US 2016/0126083 A1 May 5, 2016

(30) Foreign Application Priority Data

Jun. 7, 2013 (EP) ..... 13171109
Jun. 7, 2013 (GB) ..... 1310198.5

(51) Int. Cl.

| | |
|---|---|
| ***H01J 49/00*** | (2006.01) |
| ***H01J 49/40*** | (2006.01) |
| ***H01J 49/06*** | (2006.01) |
| ***H01J 49/42*** | (2006.01) |

(52) U.S. Cl.

CPC ..... *H01J 49/405* (2013.01); *H01J 49/062* (2013.01); *H01J 49/063* (2013.01); *H01J 49/065* (2013.01); *H01J 49/40* (2013.01); *H01J 49/4215* (2013.01); *H01J 49/4225* (2013.01); *H01J 49/4235* (2013.01)

(58) Field of Classification Search

CPC ..... H01J 49/00; H01J 49/02; H01J 49/405; H01J 49/26; H01J 49/40; H01J 49/4205; H01J 49/421; H01J 49/4215; H01J 49/422; H01J 49/4225; H01J 49/4255; H01J 49/426; H01J 49/429

USPC ..... 250/281, 282, 287, 290, 293

See application file for complete search history.

(56) References Cited

U.S. PATENT DOCUMENTS

| | | | |
|---|---|---|---|
| 5,095,208 | A | 3/1992 | Ose et al. |
| 5,847,386 | A | 12/1998 | Thomson et al. |
| 6,417,511 | B1 | 7/2002 | Russ, IV et al. |
| 6,593,570 | B2 | 7/2003 | Li et al. |
| 6,674,071 | B2 | 1/2004 | Franzen et al. |

(Continued)

*Primary Examiner* — Jason McCormack

(57) ABSTRACT

A device for manipulating charged particles using an axial electric field as they travel along a longitudinal axis of the device is disclosed. The method comprises providing an outer electrode for generating an electric field and providing a plurality of inner electrodes that are separated by gaps of different lengths. The electric field generated by the outer electrode penetrates the gaps between the inner electrodes and the gaps are selected such that the desired potential profile is arranged along the longitudinal axis in order to manipulate the charged particles in the desired manner.

21 Claims, 6 Drawing Sheets

(56) References Cited

U.S. PATENT DOCUMENTS

| | | | | |
|---|---|---|---|---|
| 6,707,037 | B2 | 3/2004 | Whitehouse | |
| 6,759,651 | B1 | 7/2004 | Li | |
| 6,815,669 | B1 * | 11/2004 | Miller | H01J 49/0018 250/286 |
| 7,196,324 | B2 | 3/2007 | Verentchikov | |
| 7,342,224 | B2 | 3/2008 | Makarov et al. | |
| 7,507,953 | B2 | 3/2009 | Makarov et al. | |
| 7,514,673 | B2 | 4/2009 | Seiko et al. | |
| 7,868,289 | B2 | 1/2011 | Cousins | |
| 8,044,349 | B2 | 10/2011 | Satake et al. | |
| 8,373,120 | B2 | 2/2013 | Verentchikov | |
| 8,541,737 | B2 | 9/2013 | Ibrahim et al. | |
| 2008/0265154 | A1 * | 10/2008 | Cousins | H01J 49/063 250/288 |
| 2010/0012835 | A1 | 1/2010 | Okumura et al. | |
| 2010/0084547 | A1 * | 4/2010 | Pringle | H01J 49/428 250/282 |
| 2010/0102217 | A1 * | 4/2010 | Okumura | G01N 27/62 250/281 |
| 2015/0270115 | A1 * | 9/2015 | Furuhashi | H01J 49/405 250/287 |

* cited by examiner

METHOD OF GENERATING ELECTRIC FIELD FOR MANIPULATING CHARGED PARTICLES

CROSS-REFERENCE TO RELATED APPLICATION

This application is the National Stage of International Application No. PCT/GB2014/051613, filed 28 May 2014 which claims priority from and the benefit of United Kingdom patent application No. 1310198.5 filed on 7 Jun. 2013 and European patent application No. 13171109.5 filed on 7 Jun. 2013. The entire contents of these applications are incorporated herein by reference.

BACKGROUND OF THE PRESENT INVENTION

The present invention relates to device for manipulating charged particles using an electric field. The preferred embodiment relates to a device for use in a mass spectrometer for manipulating ions.

It is desirable to use electric fields to manipulate ions in mass spectrometers. Typically, the device for manipulating the ions comprises a series of electrodes spaced apart along a longitudinal axis of the device. Voltages are applied to the electrodes in order to form the desired electrical potential profile along the device so as to manipulate the ions in the desired manner. The adjacent electrodes in these devices tend to be electrically connected to each other by resistors or capacitors in order to maintain each electrode at the desired potential. It may be necessary to use a number of resistors having different resistances or a number of capacitors having different capacitances in order to achieve the desired potential profile along the device. This complicates the manufacture of the device, particularly where different capacitors are required, as it is difficult to accurately alter the capacitance of a capacitor to a desired value.

An example of a device for manipulating ions in a mass spectrometer is an orthogonal acceleration Time of Flight (TOF) mass analyser. This typically comprises a series of regions of constant electric field which differ in electric field strength, such as acceleration regions and reflectrons. In order to support these fields in the bulk of the device where the ions fly, different voltages are applied to a series of discrete electrodes that closely mimic the boundary conditions of the desired internal or bulk electric field. In the example of a single stage reflectron, the reflectron is formed from a series of cylindrical electrodes of the same length that are arranged adjacent to one another and that are connected via a potential divider consisting of resistors of equal value. The resulting electric field has discontinuities close to the surfaces of the electrodes, but these discontinuities quickly relax away from the surfaces of the electrodes to provide a smooth, constant electric field that is desired for the operation of the analyser. It is desired to minimise the complexity and number of such electrodes, but to still obtain sufficient relaxation of the electric fields in the bulk of the device so as to allow successful operation of the device.

More complex, higher order electric fields may also be created along a device by applying the appropriate potential function to a series of electrodes spaced along the device. Provided that the desired bulk field is a supported field, i.e. it satisfies Laplace's equation, then the prudent application of a potential function to the discrete electrodes that closely follows the boundary condition along a defined geometrical surface will allow the electric field to quickly relax to the desired form. The accuracy of the bulk field will depend on the accuracy of the location of the electrodes and the voltages applied to them.

Although the desired potential profile may be achieved relatively easily for certain potential profiles, this becomes more difficult when it is desired for the potential profile to follow higher order functions. Problems are also encountered if the potential profile is required to be pulsed on an off. Electrodes that define a region which requires a pulsed electric field must have capacitive dividers between the electrodes so as to provide the different voltages to the different electrodes. However such dividers are generally of low tolerance and it is difficult to accurately provide the required capacitance for each capacitor. By way of example, such problems might occur in the pulsed ion extraction region of an TOF mass analyser. It is desired to provide an improved method of manufacturing a device for manipulating charged particles, an improved device, an improved mass spectrometer and an improved method of mass spectrometry.

SUMMARY OF THE PRESENT INVENTION

From a first aspect, the present invention provides a time of flight mass analyser comprising a time of flight region for manipulating ions using an axial electric field as they travel along a longitudinal axis of the time of flight region, said time of flight region comprising:

at least one outer electrode that extends continuously along at least a portion of the length of the time of flight region;

a first voltage supply connected to said outer electrode for supplying a first voltage to the outer electrode in use;

at least one set of a plurality of inner electrodes or inner electrode portions arranged between the outer electrode and said longitudinal axis along which the ions travel in use; wherein the inner electrodes or inner electrode portions are spaced apart along the length of the time of flight region so as to provide gaps between the inner electrodes or inner electrode portions; wherein the gaps have lengths in the longitudinal direction of the time of flight region, and wherein the lengths of the gaps vary as a function of the position of the gaps along the length of the time of flight region; and a second voltage supply connected to said plurality of inner electrodes or inner electrode portions, wherein the second voltage supply is configured to maintain at least some of the inner electrodes or inner electrode portions at a second voltage that is different to said first voltage.

The present invention uses an outer electrode to generate an electric field and inner electrodes that are separated by gaps to control the amount of electric field penetration to the longitudinal axis along which ions travel in use. The desired potential profile can therefore be achieved along the time of flight region by appropriate selection of the positions and lengths of the gaps between the inner electrodes. As such, the present invention provides a simple and effective mechanism for providing a desired axial potential profile along the longitudinal axis of the time of flight region. This is in contrast to conventional devices, which require many different electrical potentials to be applied to many different electrodes in order to achieve the desired potential profile along the device. These conventional devices consequently require relatively complex electronics in order to apply the many different electrical potentials to the different electrodes.

The present invention is beneficial over conventional devices such as those described above in that it is typically more straight forward to accurately machine the inner electrodes so as to provide the desired gaps between the inner electrodes than it is to accurately tailor voltage supplies to desired voltages. It is therefore easier to control the electrical potential profile according to the present invention. Furthermore, by varying the lengths of the gaps between the inner electrodes, the present invention enables non-linear axial potential profiles to be achieved without having to apply many different electrical potentials to many different electrodes and hence without having to use electrical components having many different resistances or capacitances.

Preferably, the mass analyser of the present invention is configured so that ions separate according to their mass to charge ratios as they travel through the time of flight region. The ions are preferably pulsed into, or along, the time of flight region.

The lengths of the gaps vary in the direction of the longitudinal axis of the time of flight region, preferably as measured along the same axis extending in the longitudinal direction.

Preferably, the inner electrodes or inner electrode portions and the at least one outer electrode are arranged and configured, and the first and second voltages are selected, such that in use an electric field generated by the at least one outer electrode penetrates through the gaps between the inner electrodes or inner electrode portions so as to provide an electrical potential profile along said longitudinal axis for manipulating said ions.

The thickness of the inner electrodes or inner electrode portions in the direction radially outward from the longitudinal axis is selected such that the desired electrical potential profile is provided along said longitudinal axis.

Said electrical potential profile preferably varies progressively along said longitudinal axis in a continuous and smooth manner. The potential profile preferably does not form an ion-optical lens or have sudden changes in electrical potential as a function of length along the device.

Preferably, the first and/or second voltage supply is configured to be pulsed on and off such that said electrical potential profile is pulsed on and off in use.

The inner electrodes or inner electrode portions are arranged sequentially along the length of the time of flight region, and the lengths of these electrodes or electrode portions preferably vary linearly or quadratically as a function of the position of the electrode within the sequence. Alternatively, or additionally, the gaps between the inner electrodes or inner electrode portions are arranged sequentially along the length of the time of flight region, and the lengths of these gaps may vary linearly or quadratically as a function of the position of the gap within the sequence.

The inner electrodes or inner electrode portions are arranged sequentially along the length of the device, and the lengths of the electrodes or portions (and/or the lengths of the gaps between the electrodes or portions) may vary linearly as a function of the position of the electrode or portion (or gap) within the sequence. The length of the nth electrode or portion (or the nth gap) in the sequence may be equivalent to $a.n+b$ units of length, wherein $a \neq 0$ and b is a constant or zero.

Alternatively, the lengths of the electrodes or electrode portions (or the gaps) may vary in a quadratic manner as a function of the position of the electrode or electrode portion (or gap) within the sequence. The length of the nth electrode or electrode portion (or nth gap) in the sequence may be equivalent to $a.n^2+b.n+c$ units of length, wherein $a \neq 0$, and b and c are constants or zero.

Alternatively, the lengths of the electrodes or portions (or the gaps) may vary in a cubic manner as a function of the position of the electrode or electrode portion (or gap) within the sequence. The length of the nth electrode or electrode portion (or nth gap) in the sequence may be equivalent to $a.n^3+b.n^2+c.n+d$ units of length, wherein $a \neq 0$ and b, c and d are constants or zero. Functions that are of higher order than cubic functions are also contemplated.

Preferably, the second voltage supply maintains all of the inner electrodes or electrode portions at the same voltage. The inner electrodes or inner electrode portions are preferably maintained at ground potential, i.e. maintained at 0 V, or at another non-zero voltage. Less preferably, the inner electrodes or inner electrode portions are arranged sequentially along the length of the device, and the voltages applied to the electrodes or electrode portions may vary as a function of the position of the electrode or electrode portion within the sequence. For example, the voltages applied to the inner electrodes or electrode portions may vary linearly as a function of the position of the electrode or electrode portion within the sequence. The voltage applied to the nth electrode or electrode portion in the sequence may be equivalent to $a.n+b$ volts, where "a" is $\neq 0$ and "b" is a constant or zero.

Alternatively, the voltages applied to the inner electrodes or inner electrode portions may vary in a quadratic manner as a function of the position of the electrode or electrode portion within the sequence. The voltage applied to the nth electrode or electrode portion in the sequence may be equivalent to $a.n^2+b.n+c$ volts, wherein $a \neq 0$ and b and c are zero or a constant.

Alternatively, the voltages applied to the inner electrodes or inner electrode portions may vary in a cubic manner as a function of the position of the electrode or electrode portion within the sequence. The voltage applied to the nth electrode or electrode portion in the sequence may be equivalent to $a.n^3+b.n^2+c.n+d$ volts, wherein $a \neq 0$ and b, c and d are constants or zero. Voltage functions that are of higher order than cubic functions are also contemplated.

The present invention may combine the effect of varying the lengths of the inner electrodes or inner electrode portions with the effects of applying different voltage profiles to the inner electrodes or inner electrode portions.

The at least one outer electrode may be one of: substantially planar; rod shaped; or cylindrical and arranged around the longitudinal axis. Additionally, or alternatively, each of the inner electrodes or inner electrode portions may be one of: substantially planar; rod shaped; or cylindrical and arranged around the longitudinal axis.

The outer electrode and/or inner electrodes or electrode portions may be cylindrical and arranged around the longitudinal axis. Alternatively, one of said outer electrodes may be arranged on one side of said longitudinal axis and another of said outer electrodes may be arranged on the opposite side of said longitudinal axis. One set of said inner electrodes or inner electrode portions may be arranged between each outer electrode and the longitudinal axis, on opposite sides of the longitudinal axis. More than two outer electrodes and more than two sets of inner electrodes or inner electrode portions may be arranged around the longitudinal axis, e.g. three or four outer electrodes and three or four corresponding sets of inner electrodes or electrode portions may be used.

The surface of the at least one outer electrode that is facing the longitudinal axis may be substantially parallel to said longitudinal axis.

The inner electrodes or inner electrode portions may be arranged along an axis that is substantially parallel to said longitudinal axis.

The surface of the at least one outer electrode that is facing the longitudinal axis may be arranged at an angle to the longitudinal axis such that one end of the outer electrode is further from the longitudinal axis than the other end of the outer electrode.

The at least one outer electrode has an inner surface facing the longitudinal axis, and the radial distance of said surface from the longitudinal axis may vary as a function of position along the longitudinal axis. The inner surface of the at least one outer electrode may be curved, stepped or non-linear.

The at least one outer electrode may be a plate or sheet electrode.

A plate or sheet electrode may be provided having a plurality of apertures arranged therein, wherein the portions of electrode material between said apertures form said set of inner electrode portions.

The number of electrodes or electrode portions in said set of inner electrodes or said inner electrode portions is preferably ≥5. The number of inner electrodes or inner electrode portions may be selected from the group consisting of: >3; >4; >5; >6; >7; >8; >9; >10; >15; >20; >25; or >30.

All of the inner electrodes or inner electrode portions are preferably arranged over a length of the device that is within the length of the device over which the corresponding outer electrode extends.

The device is configured such that, in use, the first voltage applied to the at least one outer electrode generates an electric field that penetrates the gaps between the inner electrodes or inner electrode portions in the at least one set of inner electrodes or inner electrode portions. The electric field penetrates the gaps so as to provide a desired electrical potential profile along the longitudinal axis along which the ions travel in use so as to manipulate the ions.

The first and/or second voltage supplies are preferably DC voltage supplies such that the electrodes are maintained at DC voltages in use; and/or the electrical potential profile is preferably an electrostatic potential profile.

Preferably, only DC potentials are applied to said at least one outer electrode and/or to said at least one set of inner electrodes or inner electrode portions.

The device may be configured to pulse the first voltage supply on and off; or the device may be configured to pulse the electrical potential profile on and off.

The electrical potential profile preferably varies along the longitudinal direction of the device, in use, so as to drive ions through the device or trap ions. For example, the electrical potential profile created along the longitudinal axis may be a quadratic potential profile or a higher order potential profile.

Said electrical potential profile is preferably the potential profile arranged substantially along the central axis of the device. The electrodes preferably surround said axis.

The voltages applied to the electrodes preferably create supported Laplacian electric fields in use.

The device is preferably arranged and configured to perform any one of the methods described herein.

The first aspect of the present invention also provides a mass spectrometer comprising a mass analyser as described hereinabove.

The first aspect of the present invention also provides a method of mass analysing ions comprising using a mass analyser as described herein. The method comprises applying said first voltage to said at least one outer electrode and applying said second voltage to said at least one set of inner electrodes or inner electrode portions so that an electric field is generated by said at least one outer electrode which penetrates the gaps between the inner electrodes or inner electrode portions so as to form an electrical potential profile along the longitudinal axis which manipulates the ions.

The electric field generated by the at least one outer electrode preferably penetrates through the gaps between the inner electrodes or inner electrode portions so as to provide an electrical potential profile along said longitudinal axis for manipulating said ions; and the electrical potential profile preferably varies in a non-linear manner along the longitudinal axis of the time of flight region; or the electrical potential profile preferably varies along the longitudinal axis of the time of flight region as a quadratic function or a higher order function.

The first aspect of the present invention also provides a method of mass spectrometry comprising the method of mass analysing ions described herein.

The first aspect of the present invention also provides a method of manufacturing a device as described herein. Accordingly, the present invention provides a method of manufacturing a time of flight mass analyser comprising a time of flight region for manipulating ions using an axial electric field as they travel along a longitudinal axis of the time of flight region, said method comprising:

selecting an electrical potential profile desired to be established along the longitudinal axis of the time of flight region in use for manipulating the ions;

providing at least one outer electrode that extends continuously along at least a portion of the length of the time of flight region;

connecting a first voltage supply to said at least one outer electrode for supplying a first voltage to the at least one outer electrode in use;

providing at least one set of a plurality of inner electrodes or inner electrode portions between the at least one outer electrode and said longitudinal axis along which the ions travel; wherein the inner electrodes or inner electrode portions are spaced apart along the length of the time of flight region so as to provide gaps between the inner electrodes or inner electrode portions; wherein the gaps have lengths in the longitudinal direction of the time of flight region, and wherein the lengths of the gaps vary as a function of the position of the gaps along the length of the time of flight region;

connecting a second voltage supply to said plurality of inner electrodes or inner electrode portions, wherein the second voltage supply is configured to maintain at least some of the inner electrodes or inner electrode portions at a second voltage in use, wherein the second voltage is different to said first voltage; and selecting the lengths of the gaps between the inner electrodes or inner electrode portions, selecting the first voltage and selecting the second voltage such that an electric field generated by the at least one outer electrode, in use, penetrates the gaps between the inner electrodes or inner electrode portions to provide said electrical potential profile along said longitudinal axis.

Although the present invention has been described above in terms of a time of flight mass analyser having a time of flight region, it is contemplated that the invention may be applied to devices other than time of flight regions or time of flight analysers.

It is contemplated that the device may be used to manipulate charged particles other than ions.

It is contemplated that, in less preferred embodiments, the lengths of the gaps between the inner electrodes or inner electrode portions need not vary in length as a function of the position of the gaps along the length of the time of flight region.

Accordingly, from a second aspect the present invention provides a device for manipulating charged particles using an axial electric field as they travel along a longitudinal axis of the device, said device comprising:

at least one outer electrode that extends continuously along at least a portion of the length of the device;

a first voltage supply connected to said at least one outer electrode for supplying a first voltage to the at least one outer electrode in use;

at least one set of a plurality of inner electrodes or inner electrode portions arranged between the at least one outer electrode and said longitudinal axis along which the charged particles travel in use; wherein the inner electrodes or inner electrode portions are spaced apart along the length of the device so as to provide gaps between the inner electrodes or inner electrode portions; and a second voltage supply connected to said plurality of inner electrodes or inner electrode portions, wherein the second voltage supply is configured to maintain at least some of the inner electrodes or inner electrode portions at a second voltage that is different to said first voltage.

The charged particles are preferably ions.

The device is preferably a reflectron for reflecting ions; an ion extraction device for accelerating pulses of ions; or a Time of Flight mass analyser.

The second aspect of the present invention also provides a mass spectrometer or ion mobility spectrometer comprising a device as described above.

The second aspect of the present invention also provides a method of manipulating charged particles comprising using a device as described above, wherein the method comprises: applying said first voltage to said at least one outer electrode and applying said second voltage to said at least one set of inner electrodes or inner electrode portions so that an electric field is generated by said at least one outer electrode which penetrates the gaps between the inner electrodes or inner electrode portions so as to form an electrical potential profile along the longitudinal axis which manipulates the charged particles.

The second aspect of the present invention also provides a method of manufacturing a device for manipulating charged particles using an axial electric field as they travel along a longitudinal axis of the device, said method comprising:

selecting an electrical potential profile desired to be established along the longitudinal axis of the device in use for manipulating the charged particles;

providing at least one outer electrode that extends continuously along at least a portion of the length of the device;

connecting a first voltage supply to said at least one outer electrode for supplying a first voltage to the at least one outer electrode in use;

providing at least one set of a plurality of inner electrodes or inner electrode portions between the at least one outer electrode and said longitudinal axis along which the charged particles travel; wherein the inner electrodes or inner electrode portions are spaced apart along the length of the device so as to provide gaps between the inner electrodes or inner electrode portions;

connecting a second voltage supply to said plurality of inner electrodes or inner electrode portions, wherein the second voltage supply is configured to maintain at least some of the inner electrodes or inner electrode portions at a second voltage in use, wherein the second voltage is different to said first voltage; and selecting the lengths of the gaps between the inner electrodes or inner electrode portions, selecting the first voltage and selecting the second voltage such that an electric field generated by the at least one outer electrode, in use, penetrates the gaps between the inner electrodes or inner electrode portions to provide said electrical potential profile along said longitudinal axis.

The second aspect of the present invention also provides a method of mass spectrometry or ion mobility spectrometry comprising the method of manipulating charged particles described herein, wherein the method comprises analysing the charged particles (i.e. ions) to determine their mass or ion mobility.

The device, spectrometer, method of manipulating charged particles, or method of spectrometry described in relation to the second aspect of the present invention may have any one, or combination, of optional or preferred features described above in relation to the first aspect of the present invention; except wherein references to the time of flight mass analyser or time of flight region refer to the device of the second aspect of the present invention, and references to ions refer to charged particles.

According to an embodiment the mass spectrometer may comprise:

(a) an ion source selected from the group consisting of: (i) an Electrospray ionisation ("ESI") ion source; (ii) an Atmospheric Pressure Photo Ionisation ("APPI") ion source; (iii) an Atmospheric Pressure Chemical Ionisation ("APCI") ion source; (iv) a Matrix Assisted Laser Desorption Ionisation ("MALDI") ion source; (v) a Laser Desorption Ionisation ("LDI") ion source; (vi) an Atmospheric Pressure Ionisation ("API") ion source; (vii) a Desorption Ionisation on Silicon ("DIOS") ion source; (viii) an Electron Impact ("EI") ion source; (ix) a Chemical Ionisation ("CI") ion source; (x) a Field Ionisation ("FI") ion source; (xi) a Field Desorption ("FD") ion source; (xii) an Inductively Coupled Plasma ("ICP") ion source; (xiii) a Fast Atom Bombardment ("FAB") ion source; (xiv) a Liquid Secondary Ion Mass Spectrometry ("LSIMS") ion source; (xv) a Desorption Electrospray Ionisation ("DESI") ion source; (xvi) a Nickel-63 radioactive ion source; (xvii) an Atmospheric Pressure Matrix Assisted Laser Desorption Ionisation ion source; (xviii) a Thermospray ion source; (xix) an Atmospheric Sampling Glow Discharge Ionisation ("ASGDI") ion source; (xx) a Glow Discharge ("GD") ion source; (xxi) an Impactor ion source; (xxii) a Direct Analysis in Real Time ("DART") ion source; (xxiii) a Laserspray Ionisation ("LSI") ion source; (xxiv) a Sonicspray Ionisation ("SSI") ion source; (xxv) a Matrix Assisted Inlet Ionisation ("MAII") ion source; and (xxvi) a Solvent Assisted Inlet Ionisation ("SAII") ion source; and/or (b) one or more continuous or pulsed ion sources; and/or (c) one or more ion guides; and/or (d) one or more ion mobility separation devices and/or one or more Field Asymmetric Ion Mobility Spectrometer devices; and/or (e) one or more ion traps or one or more ion trapping regions; and/or (f) one or more collision, fragmentation or reaction cells selected from the group consisting of: (i) a Collisional Induced Dissociation ("CID") fragmentation device; (ii) a Surface Induced Dissociation ("SID") fragmentation device; (iii) an Electron Transfer Dissociation ("ETD") fragmentation device; (iv) an Electron Capture Dissociation ("ECD")

fragmentation device; (v) an Electron Collision or Impact Dissociation fragmentation device; (vi) a Photo Induced Dissociation ("PID") fragmentation device; (vii) a Laser Induced Dissociation fragmentation device; (viii) an infrared radiation induced dissociation device; (ix) an ultraviolet radiation induced dissociation device; (x) a nozzle-skimmer interface fragmentation device; (xi) an in-source fragmentation device; (xii) an in-source Collision Induced Dissociation fragmentation device; (xiii) a thermal or temperature source fragmentation device; (xiv) an electric field induced fragmentation device; (xv) a magnetic field induced fragmentation device; (xvi) an enzyme digestion or enzyme degradation fragmentation device; (xvii) an ion-ion reaction fragmentation device; (xviii) an ion-molecule reaction fragmentation device; (xix) an ion-atom reaction fragmentation device; (xx) an ion-metastable ion reaction fragmentation device; (xxi) an ion-metastable molecule reaction fragmentation device; (xxii) an ion-metastable atom reaction fragmentation device; (xxiii) an ion-ion reaction device for reacting ions to form adduct or product ions; (xxiv) an ion-molecule reaction device for reacting ions to form adduct or product ions; (xxv) an ion-atom reaction device for reacting ions to form adduct or product ions; (xxvi) an ion-metastable ion reaction device for reacting ions to form adduct or product ions; (xxvii) an ion-metastable molecule reaction device for reacting ions to form adduct or product ions; (xxviii) an ion-metastable atom reaction device for reacting ions to form adduct or product ions; and (xxix) an Electron Ionisation Dissociation ("EID") fragmentation device; and/or (g) a mass analyser selected from the group consisting of: (i) a quadrupole mass analyser; (ii) a 2D or linear quadrupole mass analyser; (iii) a Paul or 3D quadrupole mass analyser; (iv) a Penning trap mass analyser; (v) an ion trap mass analyser; (vi) a magnetic sector mass analyser; (vii) Ion Cyclotron Resonance ("ICR") mass analyser; (viii) a Fourier Transform Ion Cyclotron Resonance ("FTICR") mass analyser; (ix) an electrostatic or orbitrap mass analyser; (x) a Fourier Transform electrostatic or orbitrap mass analyser; (xi) a Fourier Transform mass analyser; (xii) a Time of Flight mass analyser; (xiii) an orthogonal acceleration Time of Flight mass analyser; and (xiv) a linear acceleration Time of Flight mass analyser; and/or (h) one or more energy analysers or electrostatic energy analysers; and/or (i) one or more ion detectors; and/or (j) one or more mass filters selected from the group consisting of: (i) a quadrupole mass filter; (ii) a 2D or linear quadrupole ion trap; (iii) a Paul or 3D quadrupole ion trap; (iv) a Penning ion trap; (v) an ion trap; (vi) a magnetic sector mass filter; (vii) a Time of Flight mass filter; and (viii) a Wien filter; and/or (k) a device or ion gate for pulsing ions; and/or (l) a device for converting a substantially continuous ion beam into a pulsed ion beam.

The mass spectrometer may further comprise either:

(i) a C-trap and an orbitrap (RTM) mass analyser comprising an outer barrel-like electrode and a coaxial inner spindle-like electrode, wherein in a first mode of operation ions are transmitted to the C-trap and are then injected into the orbitrap (RTM) mass analyser and wherein in a second mode of operation ions are transmitted to the C-trap and then to a collision cell or Electron Transfer Dissociation device wherein at least some ions are fragmented into fragment ions, and wherein the fragment ions are then transmitted to the C-trap before being injected into the orbitrap (RTM) mass analyser; and/or (ii) a stacked ring ion guide comprising a plurality of electrodes each having an aperture through which ions are transmitted in use and wherein the spacing of the electrodes increases along the length of the ion path, and wherein the apertures in the electrodes in an upstream section of the ion guide have a first diameter and wherein the apertures in the electrodes in a downstream section of the ion guide have a second diameter which is smaller than the first diameter, and wherein opposite phases of an AC or RF voltage are applied, in use, to successive electrodes.

According to an embodiment the mass spectrometer further comprises a device arranged and adapted to supply an AC or RF voltage to the electrodes. The AC or RF voltage preferably has an amplitude selected from the group consisting of: (i) <50 V peak to peak; (ii) 50-100 V peak to peak; (iii) 100-150 V peak to peak; (iv) 150-200 V peak to peak; (v) 200-250 V peak to peak; (vi) 250-300 V peak to peak; (vii) 300-350 V peak to peak; (viii) 350-400 V peak to peak; (ix) 400-450 V peak to peak; (x) 450-500 V peak to peak; and (xi) >500 V peak to peak.

The AC or RF voltage preferably has a frequency selected from the group consisting of: (i) <100 kHz; (ii) 100-200 kHz; (iii) 200-300 kHz; (iv) 300-400 kHz; (v) 400-500 kHz; (vi) 0.5-1.0 MHz; (vii) 1.0-1.5 MHz; (viii) 1.5-2.0 MHz; (ix) 2.0-2.5 MHz; (x) 2.5-3.0 MHz; (xi) 3.0-3.5 MHz; (xii) 3.5-4.0 MHz; (xiii) 4.0-4.5 MHz; (xiv) 4.5-5.0 MHz; (xv) 5.0-5.5 MHz; (xvi) 5.5-6.0 MHz; (xvii) 6.0-6.5 MHz; (xviii) 6.5-7.0 MHz; (xix) 7.0-7.5 MHz; (xx) 7.5-8.0 MHz; (xxi) 8.0-8.5 MHz; (xxii) 8.5-9.0 MHz; (xxiii) 9.0-9.5 MHz; (xxiv) 9.5-10.0 MHz; and (xxv) >10.0 MHz.

The preferred embodiments enable a supported bulk field to be created using fewer electrodes and fewer discrete voltages. Preferably, the inner electrodes are located on a geometrical boundary of the device. For example, in a cylindrical reflectron the inner electrodes form the cylindrical inner surface of the reflectron.

BRIEF DESCRIPTION OF THE DRAWINGS

Various embodiments of the present invention will now be described, by way of example only, and with reference to the accompanying drawings, in which.

DETAILED DESCRIPTION OF PREFERRED EMBODIMENTS

Arrangements not forming part of the present invention, although helpful for understanding the invention, will first be described with reference to FIGS. 1 to 4.

Figure 1:
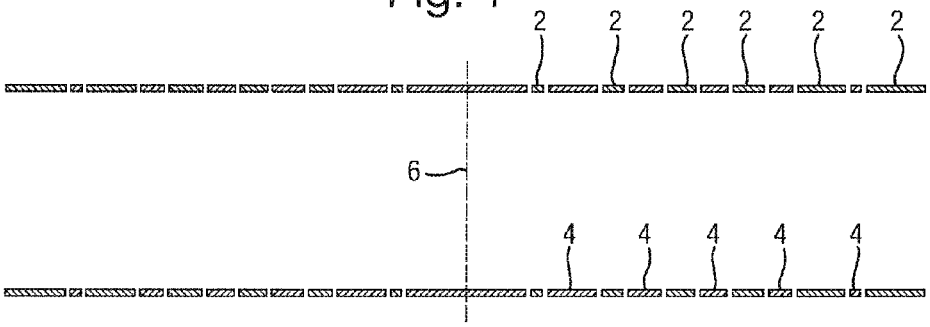
FIG. 1 shows a schematic of a device not according the present invention.

FIG. 1 shows a "perfectron" on the right hand side of the vertical dashed line 6. A "perfectron" is a cylindrical device having a parabolic potential function arranged along the length of its central axis and having defined potential surfaces at the front and rear ends of the device. The "perfectron" comprising two sets of concentric ring electrodes 2,4 arranged along a longitudinal axis of the device and having front and rear equipotential surfaces. Alternate electrodes in the device form the first set of electrodes 4 and are connected a ground potential. The electrodes in this set become progressively shorter in the longitudinal direction of the device as one moves away from the front end of the device, wherein the front end of the device is arranged at the vertical dashed line 6. The second set of electrodes 2 is connected to the ion mirror potential and comprises electrodes that become progressively longer in the longitudinal direction of the device as one moves away from the front end of the device. The lengths of the electrodes increase as a quadratic function of their distances from the front end of the device. In order to eliminate boundary condition effects of the device and to examine the true behaviour of the device, a mirror image of the device is considered to be arranged on the left hand side of the vertical dashed line 6.

FIGS. 2A to 2D show simulations of the electrical potential φ along the device (i.e. within the arrangement on the right side of the vertical dashed line 6 in FIG. 1) as a function of distance z along the device, for different radial positions within the device. The simulations assume that the device has a radius of 3 cm and a length of 20 cm. The simulation also assumes that the arrangement on the left side of the vertical dashed line 6 mirrors the device on the right side of the vertical dashed line 6. The simulation assumes that the pitch of the electrodes along the length of the device is 2 cm (i.e. ten electrodes between the entrance and exit electrodes) and that the electrodes vary in length from 0.025 to 10 mm. The simulation assumes that the first set of electrodes 4 are maintained at ground potential and that each electrode in the second set of electrodes 2 is maintained at 200 V.

Figure 2A:
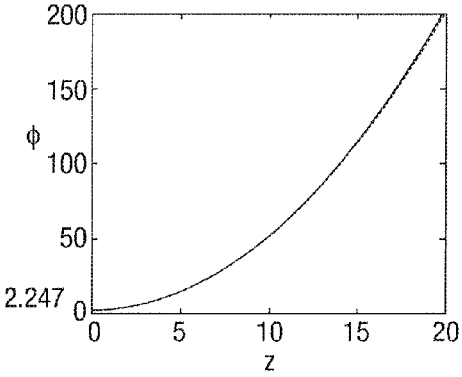
FIGS. 2A to 2D show the potential profiles maintained along the device of FIG. 1 at different radial positions within the device.

FIG. 2A shows the potential profile φ maintained along the central axis of the device due to the voltages applied to the first and second sets of electrodes 4,2. It can be seen that the potential profile φ along the central axis of the device is quadratic.

Figure 2B:
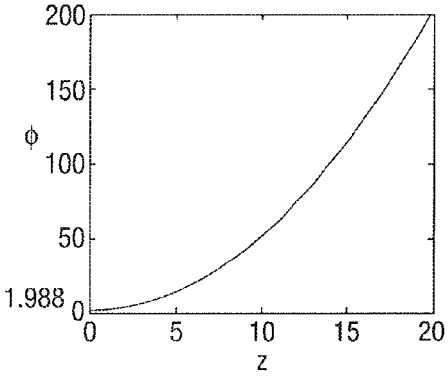

FIG. 2B shows the potential profile φ maintained along the device at a radius of 1 cm from the central axis, due to the voltages applied to the first and second sets of electrodes 4,2. It can be seen that the potential profile φ along the device at this radius is substantially quadratic.

Figure 2C:
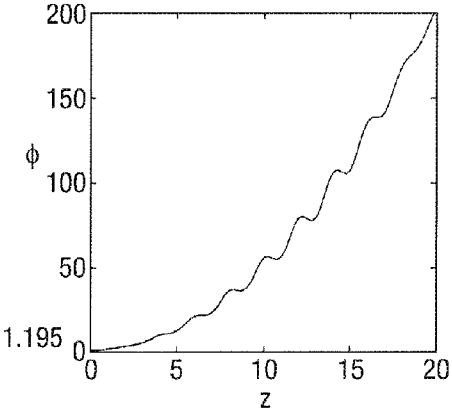

FIG. 2C shows the potential profile φ maintained along the device at a radius of 2 cm from the central axis, due to the voltages applied to the first and second sets of electrodes 4,2. It can be seen that the potential profile φ along the device at this radius follows a generally quadratic pattern, although there is a significant ripple in the potential function φ due to the electrode structure.

Figure 2D:
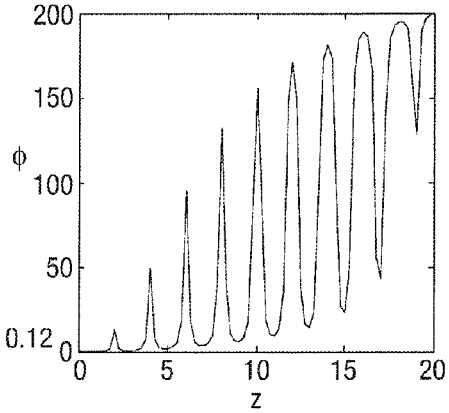

FIG. 2D shows the potential profile φ maintained along the device at a radius of 2.9 cm from the central axis, due to the voltages applied to the first and second sets of electrodes 4,2. It can be seen that the potential profile φ along the device at this radius is significantly distorted from the desired quadratic function.

FIGS. 2A to 2D illustrate that the electrode structure can be used to generate a quadratic potential along the device for manipulating ions using only two voltages, i.e. ground voltage and 200 V. This is achieved by varying the lengths of the electrodes in the second set of electrodes 2.

Figure 3:
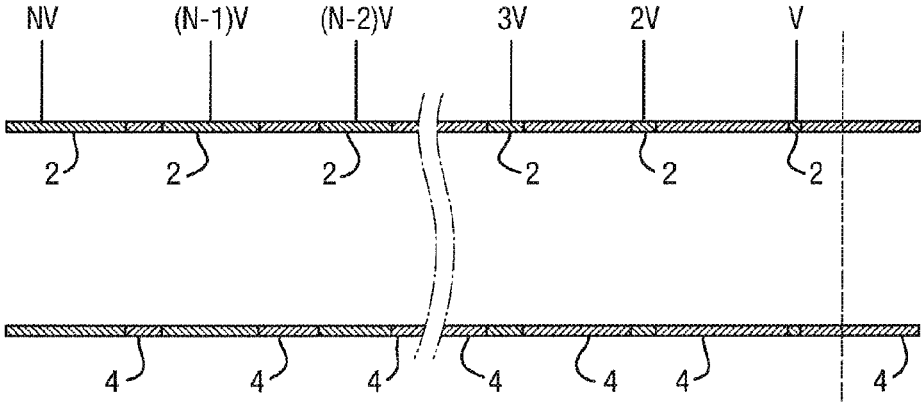
FIG. 3 shows a schematic of the electrode structure and voltages that may be applied to the electrodes in the arrangement of FIG. 1.

FIG. 3 shows another device having a first set of electrodes 4 and a second set of N electrodes 2. The electrodes in the device alternate between electrodes in the first set 4 and electrodes in the second set 2. The electrodes are arranged directly adjacent to each other so as to form a continuous, flush surface. The first set of electrodes 4 are electrically grounded and decrease in length from the right side to left side of the device. The electrodes in the second set of electrodes 2 increase in length from the right side of the device to the left side of the device. The electrodes 2 increase in length in a linear manner as a function of their distance from the right side of the device. The voltages applied to the second set of electrodes 2 increase from the right side of the device to the left side of the device. The voltages increase in a linear manner such that the nth electrode of the second set of electrodes 2 is maintained at a voltage that is a multiple of n times the voltage that the n=1 electrode is maintained at. A linear divider formed from a plurality of resistors having the same resistance is used to supply the second set of electrodes 2 with the different voltages.

The effect of linearly increasing the length of the electrodes in the second set of electrodes 2 and linearly increasing the voltages applied to these electrodes results in a quadratic axial electric field being generated along the device. The quadratic electric field increases in amplitude in the same direction along the device that the voltages and lengths of the electrodes increase. It will therefore be appreciated that the device enables a quadratic electric field to be established along the device using a linear voltage divider comprising only resistors of the same value.

Figure 4:
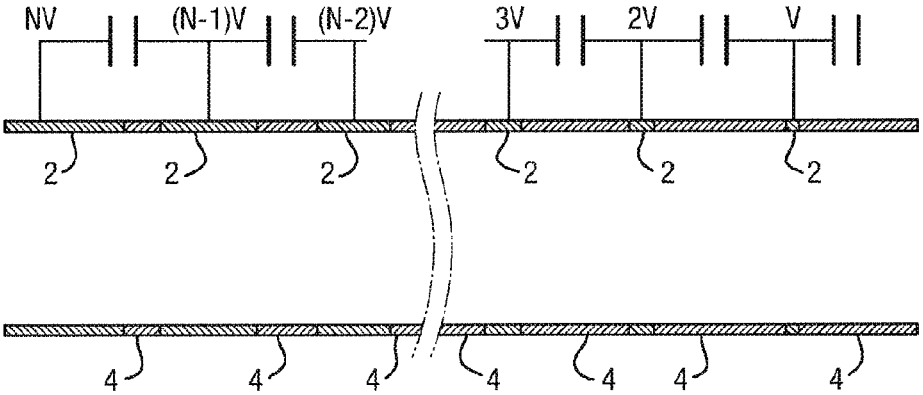
FIG. 4 shows a schematic of the electrode structure and voltages that may be applied to the electrodes in another arrangement not forming part of the present invention.

FIG. 4 shows a device that is substantially the same as that of FIG. 3 except that the voltage divider uses capacitors of the same capacitance value, rather than resistors, in order to form the voltage gradient along the second set of electrodes 2. A quadratic axial electric field is formed within the device, as described above with respect to FIG. 3. The device of FIG. 4 is particularly advantageous in the event that the axial electric field is desired to be pulsed on and off.

FIGS. 5 to 10 show schematics of embodiments of the present invention.

Figure 5A:
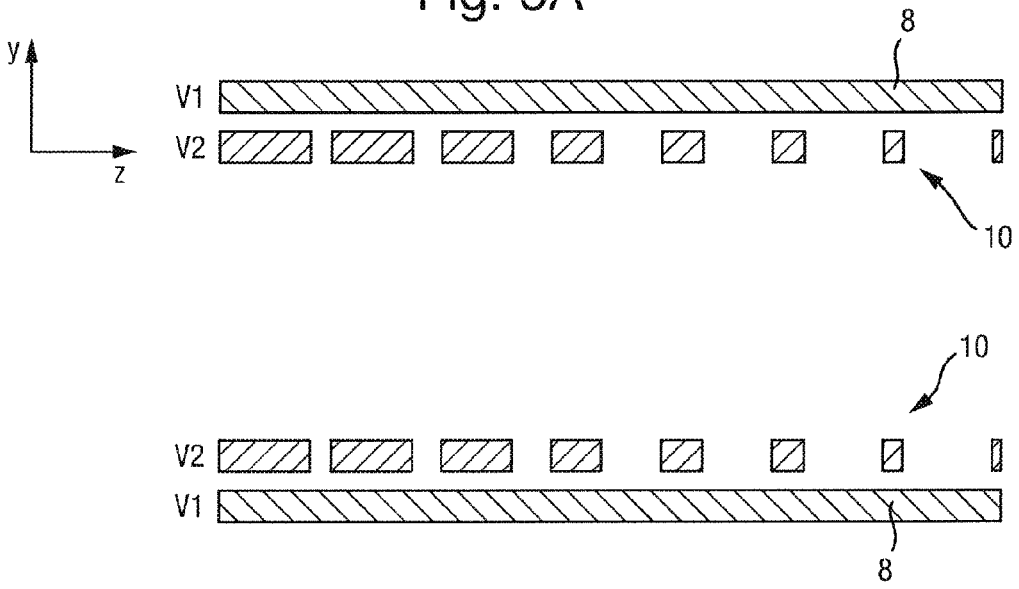
FIG. 5A shows a preferred embodiment of the present invention having parallel outer electrodes.

FIG. 5A shows a device according to a first embodiment of the present invention comprising two continuous outer electrodes 8 and two sets of inner electrodes 10 arranged between the outer electrodes 8. Each set of inner electrodes 10 is arranged along an axis parallel to the central axis of the device. The electrodes in each set of inner electrodes 10 are spaced apart in a direction along the axis such that gaps are provided between adjacent pairs of the inner electrodes 10. The lengths of the gaps between the inner electrodes 10 vary as a function of position along the device. This allows the desired axial electric potential to be maintained along the central axis, as will be described in more detail below. In this embodiment, the lengths of the gaps increase from the left to the right of the device.

Figure 5B:
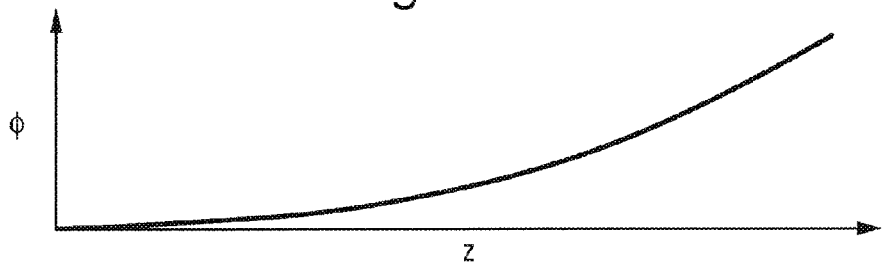
FIG. 5B shows the potential profile along the device of FIG. 5A.

A first DC voltage V1, e.g. 200 V is applied to the outer electrodes 8. The inner electrodes 10 are each maintained at a second voltage V2, which is preferably ground potential. An electric field is generated by applying the first voltage V1 to the outer electrodes 8 and this electric field penetrates through the gaps in the adjacent inner electrodes 10 so as to form a superimposed electric field along the central axis of the device. As the lengths of the gaps between the inner electrodes 10 vary along the length of the device, the amount of electric field penetration through the inner electrodes 10 also varies along the length of the device. It will therefore be appreciated that the electric field along the central axis of the device can be selected by selecting the position and lengths of the gaps between the inner electrodes 10. In the example shown in FIG. 5A the gaps between the inner electrodes 10 increase in length quadratically as a function of position along the device. This results in a substantially quadratic electrical potential φ being created along the length z of the device, as shown in FIG. 5B. In use, charged particles travel along a longitudinal axis arranged between the two sets of inner electrodes 10 and are manipulated by the axial potential profile D.

It will be appreciated that axial potential profiles other than quadratic potential profiles may be created by varying the positions and lengths of the gaps in different ways.

Figure 6:
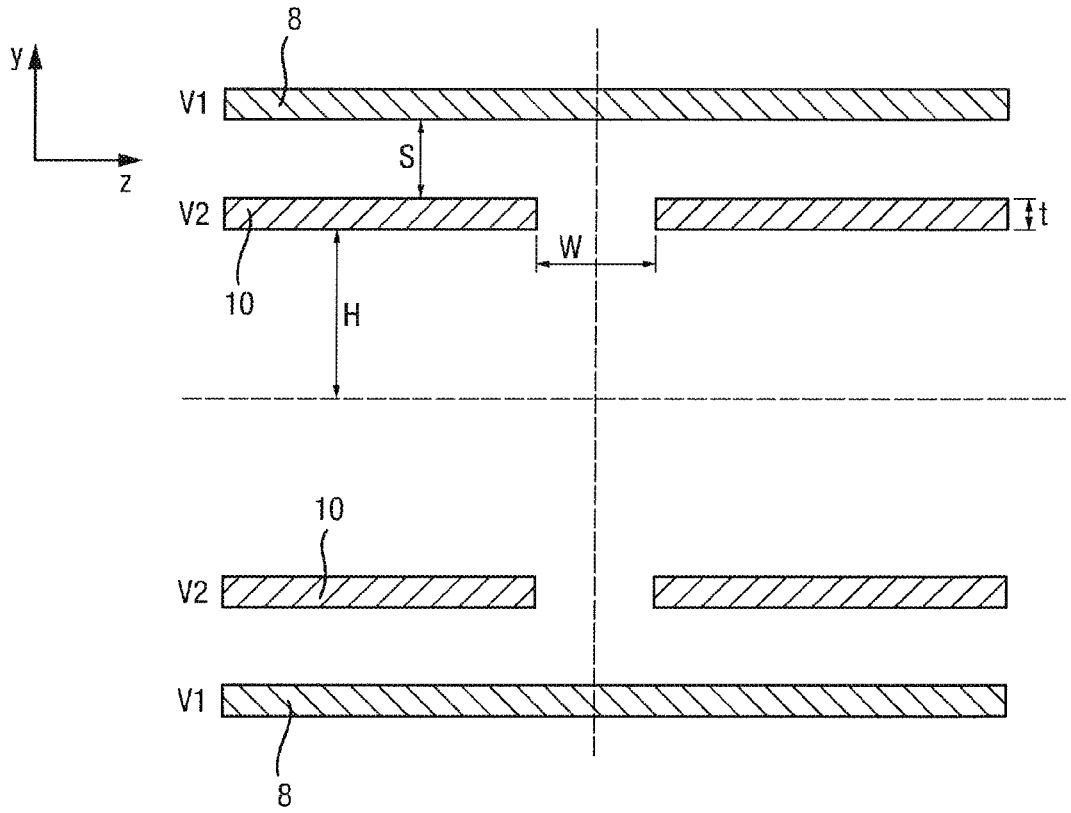
FIG. 6 shows a portion of the device of FIG. 5A.

FIG. 6 shows a portion of a length of the device of FIG. 5 in order to illustrate the parameters that may be varied in order to achieve the desired potential profile along the central axis of the device. As previously described, the length of each gap W between adjacent pairs of inner electrodes 10 may be varied in order to alter the amount of electric field penetration from the adjacent outer electrode 8 and hence alter the potential at the central axis of the device. The smaller the length W of the gap, the less field penetration there is through the inner electrodes 10. The distance S between each outer electrode 8 and the gap between the inner electrodes 10 may be varied in order to alter the amount of electric field penetration from the adjacent outer electrode 8 and hence alter the potential at the central axis of the device. The thickness t of the gap, as determined in the radial direction from the central axis, may be varied in order to alter the amount of electric field penetration from the adjacent outer electrode 8 and hence alter the potential at the central axis of the device. In the illustrated embodiment the thickness t of the gap corresponds to the thickness of the inner electrodes 10 on either side of the gap. The greater the thickness t of the gap, the less field penetration there is through the inner electrodes 10. The distance H of the inner electrodes 10 from the central axis of the device may be varied in order to alter the potential at the central axis of the device.

Figure 7:
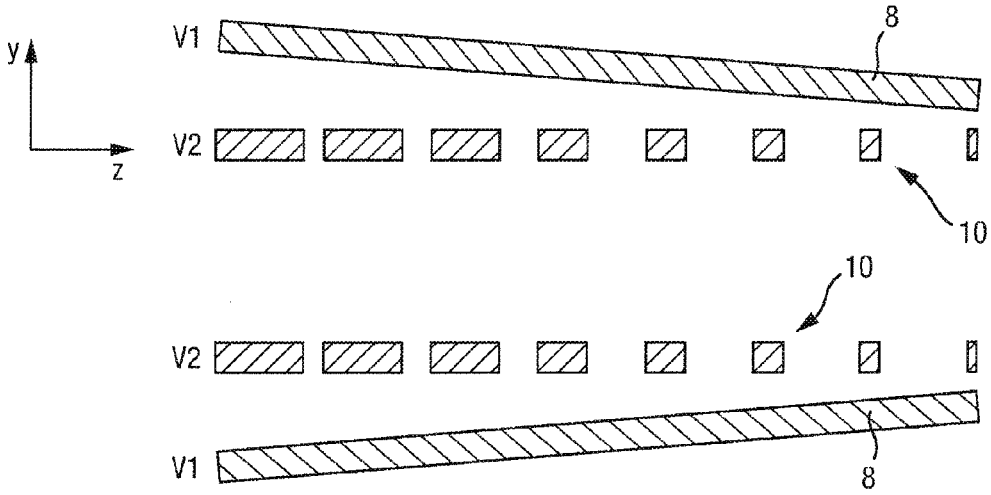
FIG. 7 shows another preferred embodiment of the present invention having non-parallel outer electrodes.

FIG. 7 shows another embodiment of the present invention that is the same as that of FIGS. 5 and 6, except that each of the outer electrodes 8 is arranged at an angle relative to the central axis and to the axes along which the inner electrodes 10 are arranged. As described in relation to FIG. 6, varying the distance between an outer electrode 8 and the gap between the adjacent inner electrodes 10 causes the electrical potential at a corresponding axial position along the central axis to vary. Accordingly, by providing angled outer electrodes 8 the distance between each outer electrode 8 and the gaps between the adjacent inner electrodes 10 varies as a function of the position along the length of the device. Angling the outer electrodes 8 therefore controls the amount of electric field penetration through the gaps in the inner electrodes 10.

Figure 8:
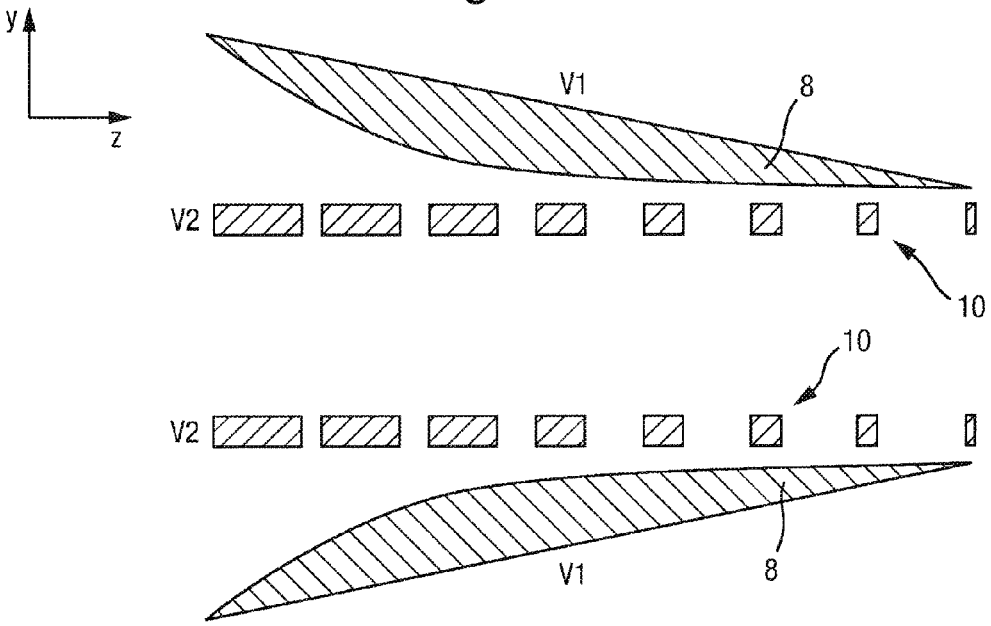
FIG. 8 shows another preferred embodiment of the present invention having curved outer electrodes.

FIG. 8 shows another embodiment of the present invention that is the same as that of FIGS. 5 and 6, except that each of the outer electrodes 8 are profiled differently. In the embodiment of FIG. 8, each outer electrode 8 has a curved surface facing the central axis such that the radial distance of said surface from the central axis (and adjacent inner electrodes 10) varies as a function of position along the longitudinal axis. As described in relation to FIG. 6, varying the distance between an outer electrode 8 and the gap between the adjacent inner electrodes 10 causes the electrical potential at a corresponding axial position along the central axis to vary. Accordingly, by providing outer electrodes 8 having curved surfaces the distance between each outer electrode 8 and the gaps between the adjacent inner electrodes 10 varies as a function of the position along the length of the device. The curved surfaces of the outer electrodes 8 therefore control the amount of electric field penetration through the gaps in the inner electrodes 10.

Figure 9:
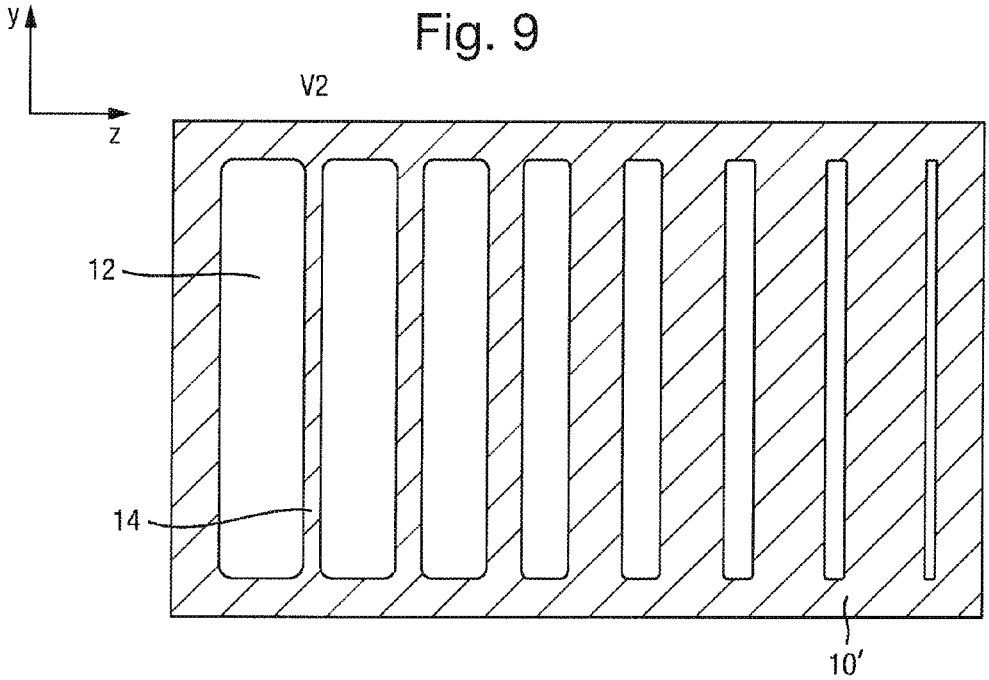
FIG. 9 shows an embodiment of an inner electrode of the preferred device.

Each set of inner electrodes 10 has been described as being formed from a plurality of discrete electrodes. However, it is contemplated a plurality of inner electrode portions may be used instead, wherein the electrode portions are portions of the same electrode that are spaced apart along the length of the device by providing apertures in the single electrode. FIG. 9 shows a schematic of such an embodiment.

FIG. 9 shows a single electrode 10' that may be used to form each set of inner electrode portions. The single electrode has a plurality of apertures (i.e. slots) 12 formed therein which define a plurality of electrode portions 14 between the apertures 12. The widths of the apertures (i.e. the dimension in the longitudinal direction of device) vary along the length of the electrode 10'. The apertured electrode 10' may be arranged in the device such that the electrode portions 14 between the apertures 12 correspond to the inner electrodes 10 of the previously described embodiments and the apertures 12 correspond to the gaps between the inner electrodes 10. In this embodiment, the inner electrode 10' is a flat plate or sheet electrode, although it is contemplated that that electrode 10' could be curved around the central axis (e.g. cylindrical) or, less preferably, could be curved along the length of the device.

Figure 10:
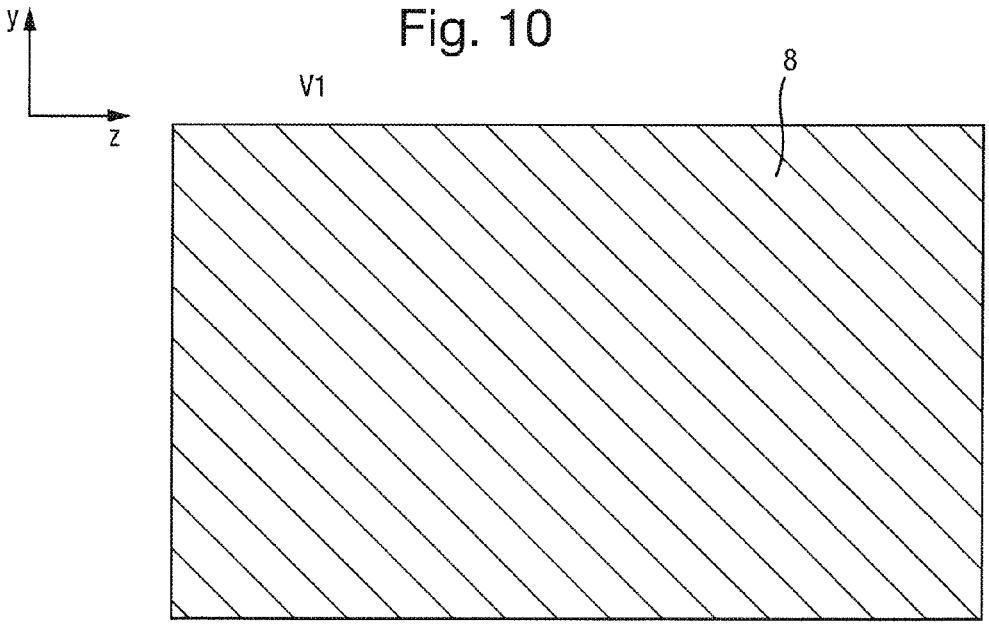
FIG. 10 shows an embodiment of an outer electrode of the preferred device.

FIG. 10 shows an embodiment of one of the outer electrodes 8 as viewed in the x-z plane. In this embodiment the electrode 8 is a solid, continuous electrode.

Each inner 10,10' electrode and/or outer electrode 8 of the present invention may be a rectilinear electrode.

The accuracy of the electric field that can be achieved according to the present invention is greater than that of conventional techniques since it is relatively easy to precisely machine the inner electrodes 10 to the desired lengths (or inner electrode portions 14) and/or provide the desired gaps between the inner electrodes (or inner electrode portions 14) in order to provide the desired potential profile along the device. The technique of the present invention is more accurate and simple than the conventional techniques, which rely upon using resistive or capacitive dividers of different values and electrical insulators between electrodes in order to provide a voltage profile along the electrodes. This is particularly the case when trying to achieve higher order potential functions which deviate from commercially available preferred values. Furthermore, as few different voltages are required to be applied to the device it is ideally suited to the rapid pulsing of electric fields which require support over large physical volumes, for example, such as those found in orthogonal acceleration TOF technology.

The present invention has general applicability to the creation of any electrostatic field, provided that the boundary conditions are known. For example, the present invention may be used to generate a hyperlogarithmic field along the length of the device. This may be useful in devices such as, for example, orthogonal acceleration TOF devices.

Although the present invention has been described with reference to preferred embodiments, it will be understood by those skilled in the art that various changes in form and detail may be made without departing from the scope of the invention as set forth in the accompanying claims.

For example, although two outer electrodes and two sets of inner electrodes have been described in relation to the illustrated embodiments, it is contemplated that the outer electrodes could be formed from a single cylinder or tube electrode that surrounds the central axis. Alternatively, or additionally, the inner electrodes could be formed from ring or tubular shaped electrodes that extend around central axis, rather than being formed from two sets of electrodes. For example, the electrode 10' may be a cylindrical or tubular electrode.

Preferably, the device described in the above embodiments is a time of flight region of a time of flight mass analyser.

Although it is preferred that the device of the present invention is for manipulating ions in a mass spectrometer, it is also contemplated that the device be used for manipulating charged particles in other applications. Examples of such other applications are the manipulation of electrons in electron microscopes, electron spectrometers or other devices.

The invention claimed is:

1. A time of flight mass analyser comprising a time of flight region for manipulating ions using an axial electric field as they travel along a longitudinal axis of the time of flight region, said time of flight region comprising:

at least one outer electrode that extends continuously along at least a portion of the length of the time of flight region;

a first voltage supply connected to said at least one outer electrode for supplying a first voltage to the at least one outer electrode in use;

at least one set of a plurality of three or more inner electrodes or inner electrode portions arranged between the at least one outer electrode and said longitudinal axis along which the ions travel in use; wherein the inner electrodes or inner electrode portions are spaced apart along the length of the time of flight region so as to provide gaps between the inner electrodes or inner electrode portions; wherein the gaps have lengths in the longitudinal direction of the time of flight region, and wherein the lengths of the gaps vary as a function of the position of the gaps along the length of the time of flight region; and a second voltage supply connected to said plurality of inner electrodes or inner electrode portions, wherein the second voltage supply is configured to maintain at least some of the inner electrodes or inner electrode portions at a second voltage that is different to said first voltage.

2. The mass analyser of claim 1, wherein the inner electrodes or inner electrode portions and the at least one outer electrode are arranged and configured, and the first and second voltages are selected, such that in use an electric field generated by the at least one outer electrode penetrates through the gaps between the inner electrodes or inner electrode portions so as to provide an electrical potential profile along said longitudinal axis for manipulating said ions.

3. The mass analyser of claim 2, wherein said electrical potential profile varies progressively along said longitudinal axis in a continuous manner.

4. The mass analyser of claim 2, wherein the first and/or second voltage supply is configured to be pulsed on and off such that said electrical potential profile is pulsed on and off in use.

5. The mass analyser of claim 1, wherein the inner electrodes or inner electrode portions are arranged sequentially along the length of the time of flight region, and wherein the lengths of these electrodes or electrode portions vary linearly or quadratically as a function of the position of the electrode within the sequence; and/or wherein the gaps between the inner electrodes or inner electrode portions are arranged sequentially along the length of the time of flight region, and wherein the lengths of these gaps vary linearly or quadratically as a function of the position of the gap within the sequence.

6. The mass analyser of claim 1, wherein the at least one outer electrode is one of: substantially planar; rod shaped; or cylindrical and arranged around the longitudinal axis; and/or wherein each of the inner electrodes or inner electrode portions is one of: substantially planar; rod shaped; or cylindrical and arranged around the longitudinal axis.

7. The mass analyser of claim 1, wherein the surface of the at least one outer electrode that is facing the longitudinal axis is substantially parallel to said longitudinal axis.

8. The mass analyser of claim 1, wherein the inner electrodes or inner electrode portions are arranged along an axis that is substantially parallel to said longitudinal axis.

9. The mass analyser of claim 1, wherein the surface of the at least one outer electrode that is facing the longitudinal axis is arranged at an angle to the longitudinal axis such that one end of the outer electrode is further from the longitudinal axis than the other end of the outer electrode.

10. The mass analyser of claim 1, wherein the at least one outer electrode has an inner surface facing the longitudinal axis, and wherein the radial distance of said surface from the longitudinal axis varies as a function of position along the longitudinal axis.

11. The mass analyser of claim 10, wherein the inner surface of the at least one outer electrode is curved, stepped or non-linear.

12. The mass analyser of claim 1, wherein the first and/or second voltage supplies are DC voltage supplies such that the electrodes are maintained at DC voltages in use; and/or wherein the electrical potential profile is an electrostatic potential profile.

13. The mass analyser of claim 1, wherein only DC potentials are applied to said at least one outer electrode and/or to said at least one set of inner electrodes or inner electrode portions.

14. A method of mass analysing ions comprising using a mass analyser as claimed in claim 11, the method comprising:

applying said first voltage to said at least one outer electrode and applying said second voltage to said at least one set of inner electrodes or inner electrode portions so that an electric field is generated by said at least one outer electrode which penetrates the gaps between the inner electrodes or inner electrode portions so as to form an electrical potential profile along the longitudinal axis which manipulates the ions.

15. The method of claim 14, wherein the electric field generated by the at least one outer electrode penetrates through the gaps between the inner electrodes or inner electrode portions so as to provide an electrical potential profile along said longitudinal axis for manipulating said ions; and wherein the electrical potential profile varies in a non-linear manner along the longitudinal axis of the time of flight region; or wherein the electrical potential profile varies along the longitudinal axis of the time of flight region as a quadratic function or a higher order function.

16. A method of manufacturing a time of flight mass analyser comprising a time of flight region for manipulating ions using an axial electric field as they travel along a longitudinal axis of the time of flight region, said method comprising:

selecting an electrical potential profile desired to be established along the longitudinal axis of the time of flight region in use for manipulating the ions;

providing at least one outer electrode that extends continuously along at least a portion of the length of the time of flight region;

connecting a first voltage supply to said at least one outer electrode for supplying a first voltage to the at least one outer electrode in use;

providing at least one set of a plurality of three or more inner electrodes or inner electrode portions between the at least one outer electrode and said longitudinal axis along which the ions travel; wherein the inner electrodes or inner electrode portions are spaced apart along the length of the time of flight region so as to provide gaps between the inner electrodes or inner electrode portions; wherein the gaps have lengths in the longitudinal direction of the time of flight region, and wherein the lengths of the gaps vary as a function of the position of the gaps along the length of the time of flight region;

connecting a second voltage supply to said plurality of inner electrodes or inner electrode portions, wherein the second voltage supply is configured to maintain at least some of the inner electrodes or inner electrode portions at a second voltage in use, wherein the second voltage is different to said first voltage; and selecting the lengths of the gaps between the inner electrodes or inner electrode portions, selecting the first voltage and selecting the second voltage such that an electric field generated by the at least one outer electrode, in use, penetrates the gaps between the inner electrodes or inner electrode portions to provide said electrical potential profile along said longitudinal axis.

17. A device for manipulating charged particles using an axial electric field as they travel along a longitudinal axis of the device, said device comprising:

at least one outer electrode that extends continuously along at least a portion of the length of the device;

a first voltage supply connected to said at least one outer electrode for supplying a first voltage to the at least one outer electrode in use;

at least one set of a plurality of three or more inner electrodes or inner electrode portions arranged between the at least one outer electrode and said longitudinal axis along which the charged particles travel in use; wherein the inner electrodes or inner electrode portions are spaced apart along the length of the device so as to provide gaps between the inner electrodes or inner electrode portions, wherein the lengths of the gaps vary as a function of the position of the gaps along the length of the device; and a second voltage supply connected to said plurality of three or more inner electrodes or inner electrode portions, wherein the second voltage supply is configured to maintain at least some of the inner electrodes or inner electrode portions at a second voltage that is different to said first voltage.

18. A mass spectrometer or ion mobility spectrometer comprising a device according to claim 17.

19. A method of manipulating charged particles comprising using a device as claimed in claim 17, the method comprising:

applying said first voltage to said at least one outer electrode and applying said second voltage to said at least one set of inner electrodes or inner electrode portions so that an electric field is generated by said at least one outer electrode which penetrates the gaps between the inner electrodes or inner electrode portions so as to form an electrical potential profile along the longitudinal axis which manipulates the charged particles.

20. A method of mass spectrometry or ion mobility spectrometry comprising the method of manipulating charged particles claimed in claim 19, wherein the method comprises analysing the charged particles to determine their mass or ion mobility.

21. A method of manufacturing a device for manipulating charged particles using an axial electric field as they travel along a longitudinal axis of the device, said method comprising:

selecting an electrical potential profile desired to be established along the longitudinal axis of the device in use for manipulating the charged particles;

providing at least one outer electrode that extends continuously along at least a portion of the length of the device;

connecting a first voltage supply to said at least one outer electrode for supplying a first voltage to the at least one outer electrode in use;

providing at least one set of a plurality of three or more of inner electrodes or inner electrode portions between the at least one outer electrode and said longitudinal axis along which the charged particles travel; wherein the inner electrodes or inner electrode portions are spaced apart along the length of the device so as to provide gaps between the inner electrodes or inner electrode portions, wherein the lengths of the gaps vary as a function of the position of the gaps along the length of the device;

connecting a second voltage supply to said plurality of inner electrodes or inner electrode portions, wherein the second voltage supply is configured to maintain at least some of the inner electrodes or inner electrode portions at a second voltage in use, wherein the second voltage is different to said first voltage; and selecting the lengths of the gaps between the inner electrodes or inner electrode portions, selecting the first voltage and selecting the second voltage such that an electric field generated by the at least one outer electrode, in use, penetrates the gaps between the inner electrodes or inner electrode portions to provide said electrical potential profile along said longitudinal axis.

* * * * *